US005890593A

United States Patent [19]

Humphrey

[11] Patent Number: 5,890,593

[45] Date of Patent: Apr. 6, 1999

[54] FREE STANDING TAMPER PROOF PACKAGE FOR PRODUCT DISPLAY

[75] Inventor: Neall W. Humphrey, El Dorado Hills, Calif.

[73] Assignee: Trade Source International, El Dorado Hills, Calif.

[21] Appl. No.: 877,261

[22] Filed: Jun. 17, 1997

[51] Int. Cl.[6] ..... B65D 73/00

[52] U.S. Cl. ..... 206/471; 206/776

[58] Field of Search ..... 206/461, 462, 206/463, 467, 468, 471, 775, 776, 781, 782

[56] References Cited

U.S. PATENT DOCUMENTS

| | | | |
|---|---|---|---|
| 4,669,610 | 6/1987 | Lindsey et al. | 206/471 X |
| 4,724,964 | 2/1988 | Hernandez | 206/462 X |
| 4,739,883 | 4/1988 | Mohs et al. | 206/467 X |
| 5,291,995 | 3/1994 | von Agris et al. | 206/467 X |

*Primary Examiner*—Jacob K. Ackun
*Attorney, Agent, or Firm*—Oppenheimer Wolff & Donnelly LLP

[57] ABSTRACT

A free standing or hook suspended tamper resistant package is disclosed for containing a product for display therein on a store shelf or the like. The package is free standing and protects the product contained therein from damage during shipment and display and prevents one from tampering with the contents of the package while displaying the product to the public.

8 Claims, 4 Drawing Sheets

29
13
36
35
28
30
15
10
19
23
21
17
12
32
18
22
33
24
20
25
27
16
11
37
34
31

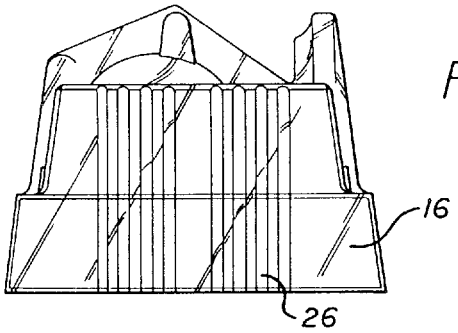
FIG. 3
FIG. 6
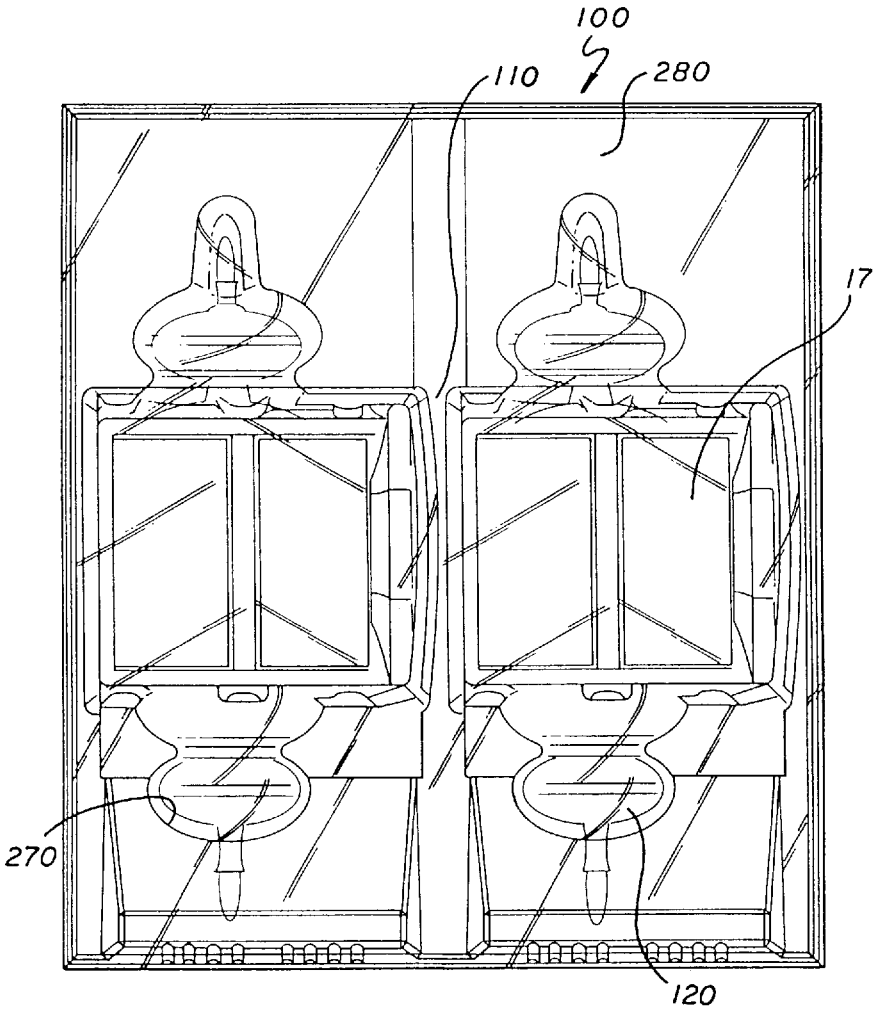

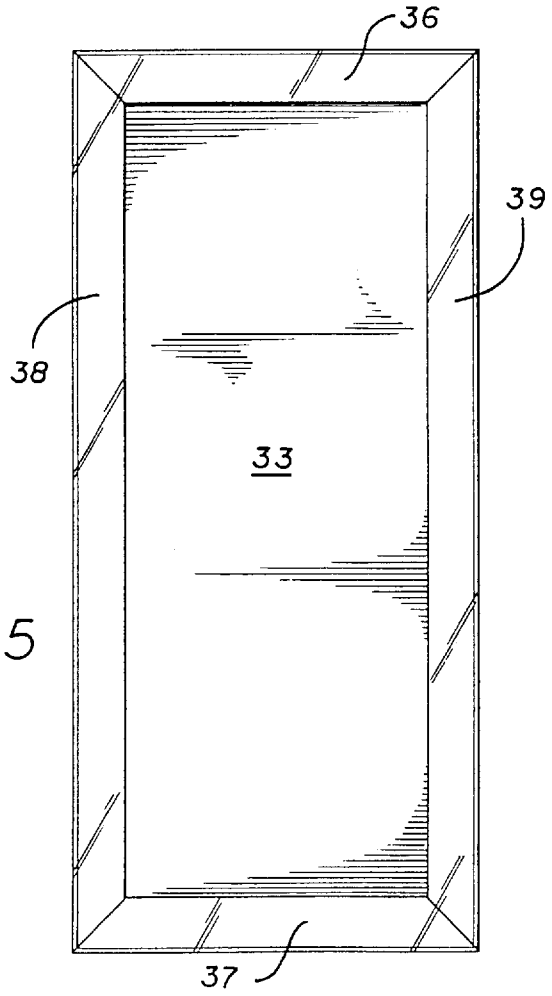
FIG. 5
FIG. 4
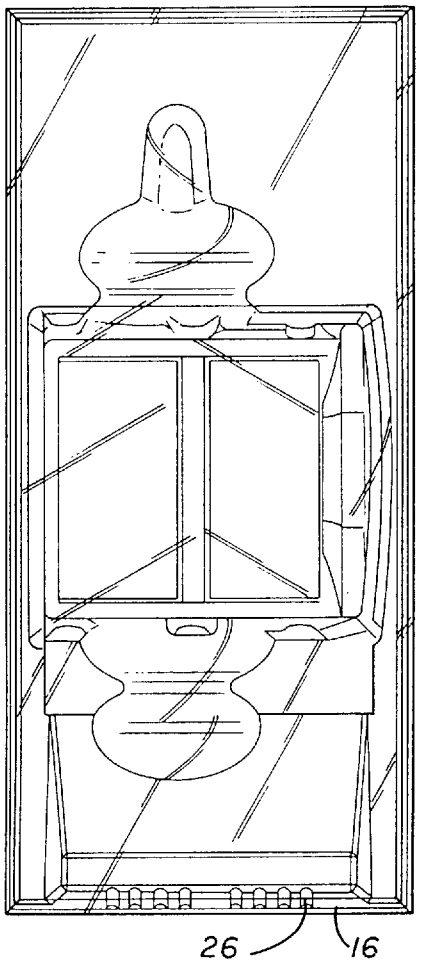

FREE STANDING TAMPER PROOF PACKAGE FOR PRODUCT DISPLAY

BACKGROUND OF THE INVENTION

The invention relates to package design; and, more particularly to a free standing or hook suspended tamper proof package for product display.

BACKGROUND INFORMATION

Various package designs are known in the art and certain ones of such package designs are usually stacked on a shelf or the like or may be suspended on hooks. Such packages have an opaque cardboard casing which may have a transparent viewing area wherein the interior of the package is visible. In the past, some products were packaged in a box allowing the customers to open the product and handle it, remove parts, damage the product, etc. Some products may be mounted in the interior of a package and be viewable through the transparent viewing area. In some cases, the product may be blister wrapped with a transparent covering around the product which also forms the transparent viewing area.

There is a need for a free standing or hook suspended tamper resistant package for displaying products wherein the package may be placed on a shelf or hung from a hook and the product inside of the package is visible. Such a package should allow the customer to examine the product through the transparent viewing area without damaging the product with fingerprints, removed product, damaged package, etc.

SUMMARY OF THE INVENTION

It is an object of this invention to provide a free standing or hook suspended tamper resistant package or product display.

It is a further object of this invention to provide such a package which displays a fully or partially assembled product therein allowing the customer to examine the product without damage to the same or to the packaging.

It is another object to carry out the foregoing objects wherein the package protects the products disposed therein from damage during shipping and display.

These and other objects are preferably accomplished by providing a free standing or hook suspended tamper resistant package containing a product for display therein. The package can be placed on a store shelf or the like. The package is free standing and protects the product contained therein from damage during shipment and display and prevents an individual from handling and tampering with the contents of the package while displaying the product to the public.

BRIEF DESCRIPTION OF THE DRAWING

FIG. 3 is a bottom plan view of the package of FIGS. 1 and 2;

FIG. 4 is a front elevational view of the package of FIGS. 1 to 3;

FIG. 5 is a rear elevational view of the package of FIGS. 1 to 4; and FIG. 6 is a front elevational view of a modification of the package of FIG. 1.

DESCRIPTION OF THE PREFERRED EMBODIMENTS

Figure 1:
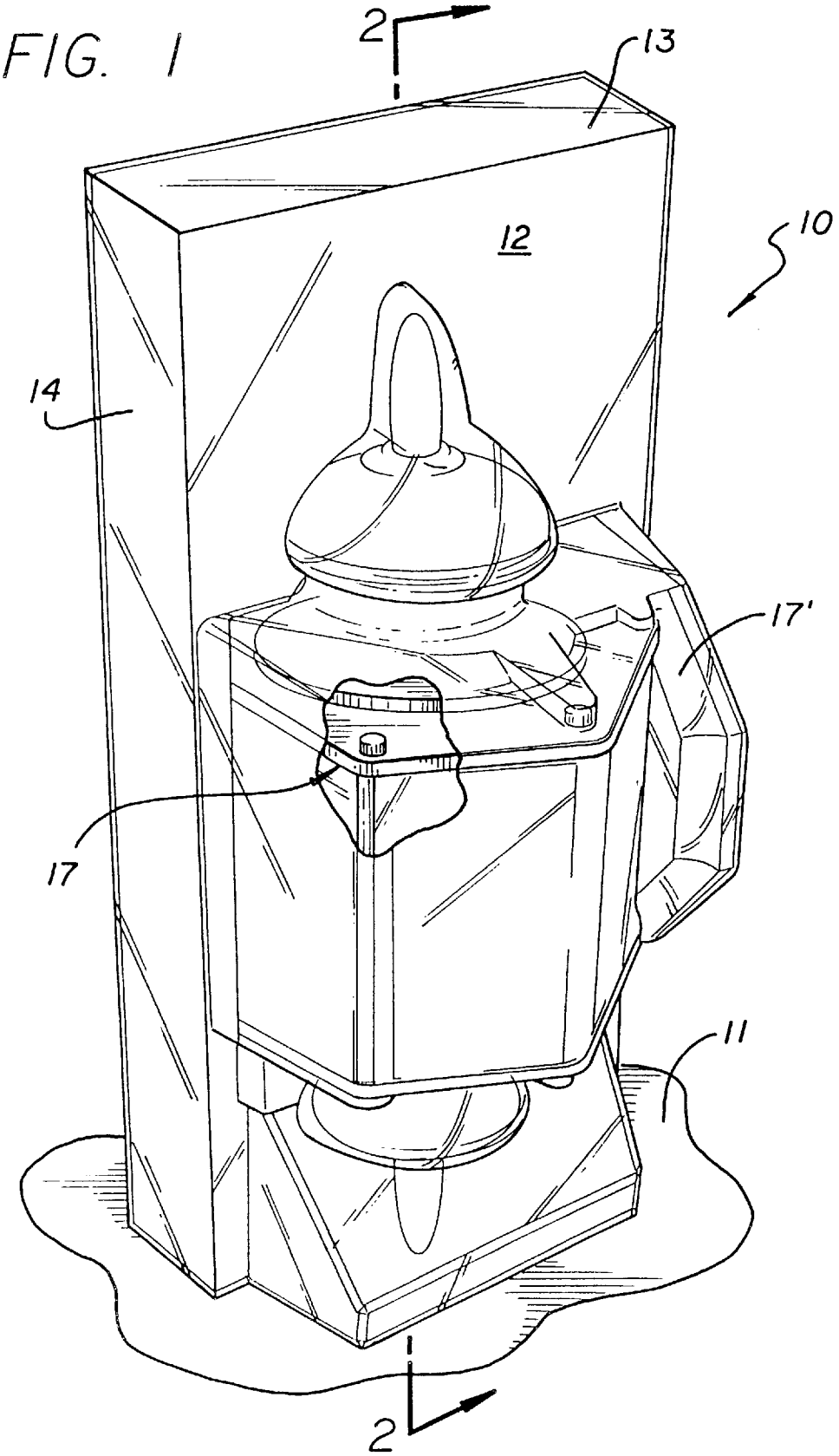
FIG. 1 is a perspective view of a package in accordance with the teachings of the invention.
Figure 2:
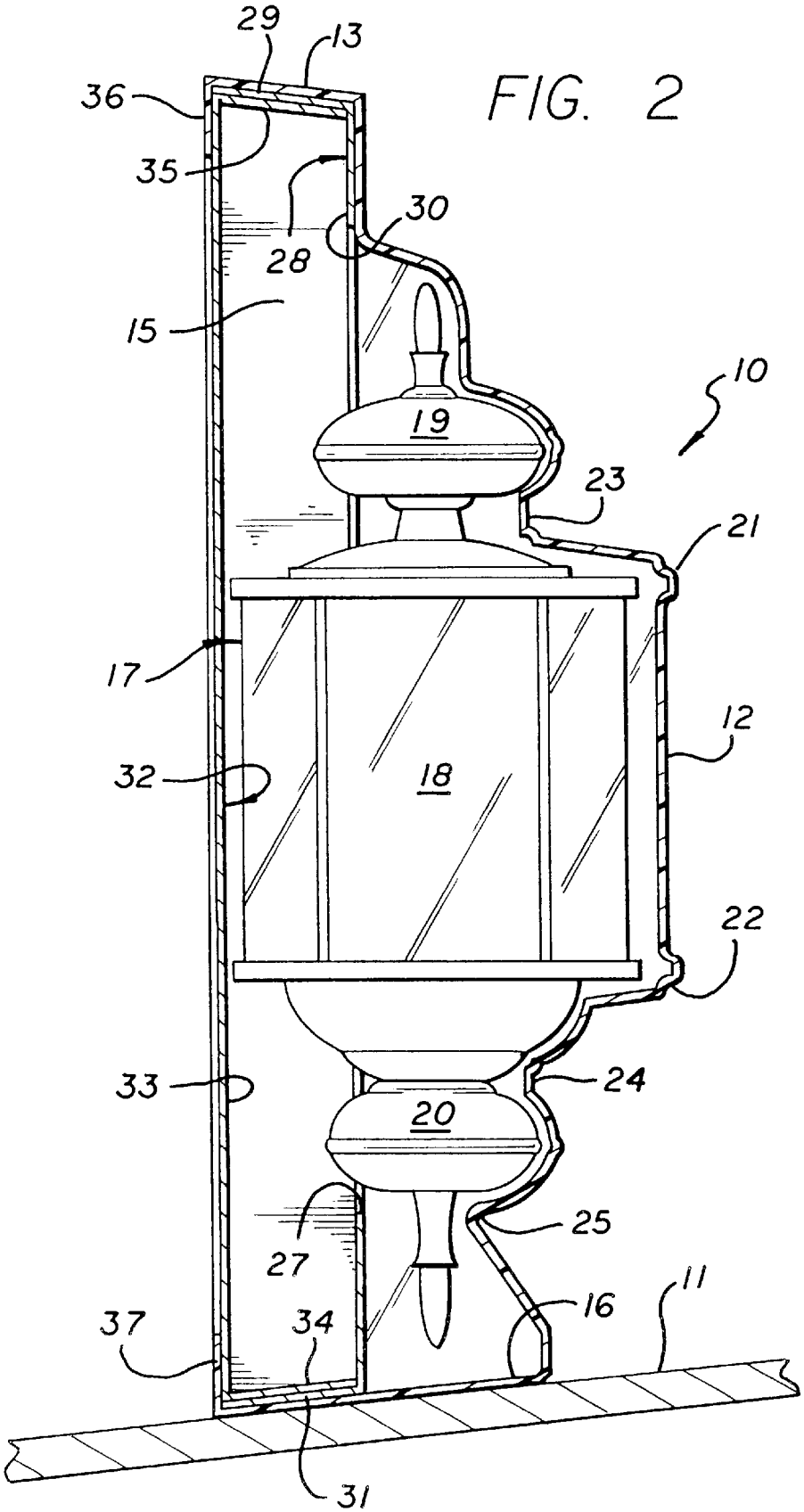
FIG. 2 is a view taken along lines 2—2 of FIG. 1.

Referring now to FIG. 1 of the drawings, a package 10 is shown resting on a supporting surface 11. Package 10 is generally rectangular in shape having a transparent panel of plastic material comprised of a front wall 12, an integral top wall 13, integral side walls 14, 15 (see also FIG. 2), and an integral bottom wall 16. Walls 12, 13, 14, 15, and 16 thus are all one integral piece of a transparent plastic material which may be laminated. Such material may be clear, tinted or frosted or the like. As seen in FIGS. 1 and 2, this plastic material may be contoured around the product being displayed therein, in this case a lighting fixture 17 which may be hardwired. Lighting fixture 17 may be substantially fully assembled, such as having a base 17', to be assembled to the lighting fixture 17, disposed side by side in the same package 10 (FIG. 1). The product being displayed thus may be any suitable product and may be partially or completely assembled. The lighting fixture 17 has a main middle body portion 18, an integral top 19 and an integral bottom 20.

As seen in FIG. 2, the contours of front wall 12 extend about the front of lighting fixture 17 forming stronger portions of the plastic material due to the bends and depressions, such as corners 21, 22 and depressions 23, 24, 25. Thus, such contouring, which may be done by heat molding of the plastic material about lighting fixture 17, does three things: first, it displays the fully or partially assembled lighting fixture 17. Second, it enhances protection of the lighting fixture 17 from tampering. Third, the strength and rigidity of the plastic material, which may be contoured, protects the lighting fixture 17 from damage.

As seen in FIG. 2, there is a slight angular slope to top wall 13 and bottom wall 16 (in opposite directions) which gives a stylish forward tilt to package 10 when resting on supporting surface 11. Also, as shown in FIGS. 3 and 4, a plurality of spaced ridges or flutes 26 may be provided at suitable locations, such as bottom wall 16, giving added strength to the particular location.

Lighting fixture 17 is supported internally inside of package 10 by being mounted and supported within a cut-out area 27 (FIG. 2) of a cardboard insert 28. Insert 28 has a top wall 29 (below wall 13), an integral front wall 30 (having cut-out area 27 therein) and, an integral bottom wall 31 (above wall 16). Another cardboard insert 32 forms the rear support wall of package 10 and includes a back wall 33, a bottom wall 34 (above wall 31) and a top wall 35 (below wall 29). As seen in FIG. 2, the plastic top wall 13 extends down over an upper portion of back wall 33 forming an upper back flange 36. In like manner, the plastic bottom wall 16 extends up over a lower portion of back wall 33 forming a lower back flange 37. As seen in FIG. 5, similar lower left and right side flanges 38, 39, respectively, extend between flanges 36, 37.

Indicia may be provided on the outside (FIG. 5) of back panel 33, such as use and installation instructions, the outside of side panels 14, 15, and the front of front panel 30, all visible through the plastic material.

Although a single product is shown mounted on package 10 of FIGS. 1 to 5, as seen in FIG. 6, a package 100, otherwise identical, except as indicated, to package 10 but larger, may be provided to dispose a plurality of products side by side. Thus, a pair of lighting fixtures 17 may be mounted inside of package 100, the only difference, other than size, being that the transparent panel has two contoured areas in front wall 120 and partition or cardboard insert 280 has a pair of cut-out areas 270 separated by a vertical panel 110. Such lighting fixtures can also differ from one another.

It can be seen that there is disclosed a unique packaging system for residential or commercial lighting products, such as lighting fixtures. The transparent plastic material comprising front wall 12, side walls 14, 15 and top and bottom walls 13, 16 may be clear, tinted, frosted, etc., and is form-fitted about the product displayed creating a self-merchandising product.

The advantage of the foregoing are as follows:

1. The customer is able to view all or part of the actual product being displayed while in its packaging rather than seeing a pictorial representation of the product.
2. Product comes in packaging fully or partially assembled, which eliminates the inconvenience or need for the customer to assemble the product on their own. Product is delivered to the customer in a more user friendly condition. A full or partial assembled product by the manufacturer reduces consumer failure of proper assembly and hazards associated with assembly procedure.
3. The product package has the versatility of allowing the package to be displayed on a peg, hook, clip-strip, shelf or it can be stacked one on top of another. Expensive shelving can be eliminated if the product is "pegged" or hung.
4. The packaging system herein reduces the possibility of parts being removed from the packaging while in the store. Small assembly parts shrinkage is a major problem for most vendors/retailers that utilize standard packaging. The packaging system herein greatly reduces the possibility of a person handling the actual product. This greatly reduces the possible occurrence of breakage, scratching, degrading or alteration of the appearance, etc. Handling of product could transfer oils, soiling, etc. from the skin which could tarnish, soil or alter the product to look "used" rather than "new" and therefore unsalable.
5. The packaging system herein allows for a fully or partially assembled product to be displayed which dramatically reduces the chances of missing parts and mismatched or incorrectly sized components.
6. The packaging system disclosed herein may be "form-fitted" to the contour of the product. The packaging can adapt to any style, size, radius, or diameter of product. This system greatly reduces product damage from hazards such as handling, shock or vibration while in transit or while in the store, etc. While the packaging system is form fitted, the unique properties and materials used in the packaging system allow the design to incorporate further enhancements to the structural qualities of the packaging system, such as "flutes," "ribs," "dimples," waves," "ridges," etc. of any radius or diameter. For example, flutes 26 are provided on the bottom of package 10 and such flutes may be applied elsewhere on package 10. Such enchancements, particularly in critical areas, may increase the strength of the packaging dramatically (similar to the difference in structural strength between a flat sheet of steel and an "I" beam).
7. The packaging herein uses a unique "foot" or base which gives the retailer the versatility to stand the product up on a shelf if desired. This packaging system may be form fitted to any portion of the product to allow the product to stand on its own.
8. The packaging system herein allows the product to be hung on a hook, peg, or any type of hanging system, if desired.

Although a particular embodiment of the invention is disclosed, variations thereof may occur to an artisan and the scope of the invention is only to be limited by the scope of the appended claims.

I Claim:

1. A free standing tamper resistant package having a front end and a back end spaced from the front end for a product display comprising:

a transparent front panel forming said front end of said package comprised of a front wall, an integral top wall, an integral bottom wall and integral spaced side walls, a portion of said panel having a contoured portion contoured in the shape of at least said one product disposed internally of said package, said contoured portion extending about the front of a product displayed therein, said integral top wall and bottom wall being generally flat and planar extending at an angle upwardly and downwardly respectively from a point at an intersection with said front wall rearwardly toward the back of said package, said spaced side walls being generally flat and planar extending from a point at an intersection with said front wall rearwardly toward the back end of said package;

an inner generally vertically extending partition having at least one cut-out portion therein contoured to the peripheral shape of said product disposed inside of said package with said product adapted to be mounted in said at least one cut-out portion and retained therein for displaying the same, said partition having integrally formed upper and lower walls disposed adjacent to and extending along said top and bottom walls of said front panel; and a generally vertically extending rear panel forming the back end of said package spaced from said partition and closing off the rear of said package, said rear panel having integrally formed upper and lower walls disposed adjacent said top and bottom walls of said front panel and being generally perpendicular to said top and bottom walls, for supporting said package in an upright position on a supporting surface.

2. The package of claim 1 wherein said bottom wall of said front panel is fluted on its under surface.

3. The package of claim 1 including a substantially fully assembled lighted fixture mounted inside said package, said fixture having a mid body portion, an integral top and an integral bottom, the lighting fixture bottom being supported in the said at least cut-out portion of said partition, and the body portion being adapted to abut against rear panel when said lighting fixture shifts rearwardly in said package.

4. The package of claim 2 wherein said lighting fixture has a reduced neck portion between said top and said body portion and a reduced neck portion between said bottom and said body portion, said front panel curving around said top and bottom, about said body portion and into said neck portions forming strengthened areas of said front panel lending rigidity to said package.

5. The package of claim 1 wherein said rear panel has a front face facing the interior of said package and a rear face on opposite side of said front face, and indicia disposed on the rear face of the rear panel.

6. The package of claim 1 wherein said inner partition having indicia adjacent said cut-out portion.

7. The package of claim 1 wherein said top wall of said front panel has a flange extending downwardly normal to the top wall of said front panel and parallel to and abutting against said rear panel, said bottom wall of said front panel has a flange extending upwardly to normal to the bottom wall of said front panel and parallel to and abutting against said rear panel.

8. The package of claim 7 wherein said side walls of said front panel includes a first side wall and second side wall, said first side wall of said front panel having a flange extending inwardly normal to said first side wall and parallel to and abutting against said rear panel, and said second side wall of said front panel having a flange extending inwardly normal to said second side wall toward said flange of said first side wall and parallel to and abutting against said rear panel.

* * * * *